US005168848A

United States Patent [19]

Bergmann et al.

[11] Patent Number: 5,168,848

[45] Date of Patent: Dec. 8, 1992

[54] ENGINE BRAKE FOR A MULTI-CYLINDER INTERNAL COMBUSTION ENGINE

[75] Inventors: Horst Bergmann; Emil Bäuerle, both of Esslingen; Thomas Harr, Tiefenbronn, all of Fed. Rep. of Germany

[73] Assignee: Mercedes-Benz AG, Fed. Rep. of Germany

[21] Appl. No.: 800,095

[22] Filed: Nov. 29, 1991

[30] Foreign Application Priority Data

Dec. 1, 1990 [DE] Fed. Rep. of Germany ..... 4038334

[51] Int. Cl.[5] ..... F02D 9/06

[52] U.S. Cl. ..... 123/324; 123/323

[58] Field of Search ..... 123/324, 323, 320, 315, 123/316, 69 R

[56] References Cited

U.S. PATENT DOCUMENTS

| | | | |
|---|---|---|---|
| 4,289,094 | 9/1981 | Tanahashi | 123/69 R |
| 4,473,047 | 9/1984 | Jakuba et al. | 123/323 |
| 4,773,440 | 9/1988 | Yanagawa et al. | 123/323 |
| 5,022,367 | 6/1991 | Morikawa | 123/324 |
| 5,036,811 | 8/1991 | Weiss et al. | 123/323 |

FOREIGN PATENT DOCUMENTS

| | | | |
|---|---|---|---|
| 0111232 | 6/1984 | European Pat. Off. | 123/324 |
| 3839451 | 5/1990 | Fed. Rep. of Germany | 123/324 |

*Primary Examiner*—Raymond A. Neill

*Attorney, Agent, or Firm*—Evenson, Wands, Edwards, Lenahan & McKeown

[57] ABSTRACT

An engine brake arrangement for a multi-cylinder internal combustion engine with at least one throttle valve per cylinder which, during braking operation of the internal combustion engine, is opened at times to connect a cylinder space with an exhaust conduit. To permit simple control of the opening and closing periods of the throttle valves, the latter are actuated by a hydraulic fluid, which is pumped by a pump with a single pressure-increasing and pumping element, and is distributed in a distributor with rotating channels to the individual conduits leading to a particular throttle valve.

20 Claims, 1 Drawing Sheet

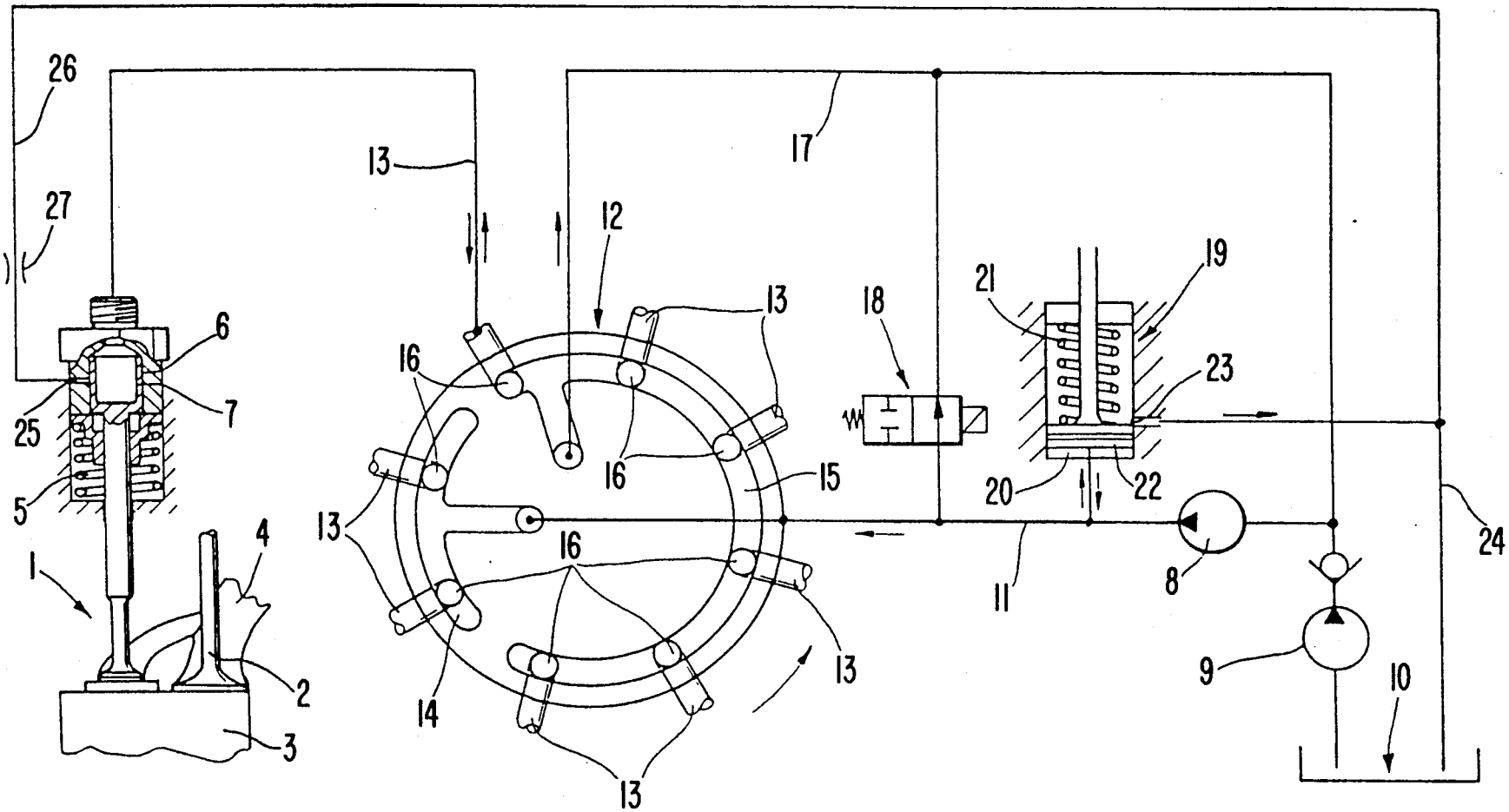
24
10
9
8
19
23
22
21
20
11
18
17
15
13
12
16
14
2
3
4
6
7
5
1
25
26
27

ENGINE BRAKE FOR A MULTI-CYLINDER INTERNAL COMBUSTION ENGINE

BACKGROUND AND SUMMERY OF THE INVENTION

The present invention concerns an engine brake for a multicylinder internal combustion engine.

An engine brake of this generic type is disclosed in European Patent Document EP 0 111 232 A1, in which a master piston in a master cylinder is arranged in a common pump casing for each throttle valve, and generates the opening pressure. This arrangement, however, requires great technical complexity, particularly in manufacture and assembly, because many manufacturing steps are necessary on the pump casing and many individual moving parts have to be installed in it. An object of the present invention is to provide an engine brake of the above mentioned generic type which has a substantially simplified construction requiring lower expenditure and which, in particular, permits a simple control of the opening times of the throttle valves.

This object is achieved in the engine brake according to the invention, in which the hydraulic fluid needed to operate all the throttle valves is pumped, and the pressure necessary in this fluid is generated, by a single element such as, for example, a master piston operating in a master cylinder. In addition, the distribution of the hydraulic fluid to the individual throttle valves takes place by means of an easily manufactured distributor which determines in one working process both the timing and the frequency of the fluid supply to the individual throttle valves, and hence the opening timing and frequency thereof.

In a representative embodiment of the invention, an arrangement is provided which avoids interference with the control system of the exhaust valves and makes the opening times of the throttle valves, independent of the control system for the exhaust valves without further complication. The use of a throttle valve in additional to an exhaust valve, which is opened or closed during braking operation of the internal combustion engine as a function of the pressure difference between the cylinder and the exhaust conduit, is disclosed in German Patent Document DE 30 39 451 A1; however, the opening times of this throttle valve cannot be controlled externally in a specified manner.

Other objects, advantages and novel features of the present invention will become apparent from the following detailed description of the invention when considered in conjunction with the accompanying drawings.

BRIEF DESCRIPTION OF THE DRAWING

The single Figure shows a schematic diagram of an engine brake according to the invention.

DETAILED DESCRIPTION OF THE DRAWING

Referring to the Figure, a throttle valve a which is additional to a conventional exhaust valve 2, connects a cylinder 3 to an exhaust conduit 4 of a multi-cylinder four-stroke internal combustion engine, which is not shown in further detail, but is an eight-cylinder engine in the illustrative example. The opening motion of the throttle valve 1 is effected against the force of a return spring 5 by a slave piston 7 guided in a slave cylinder 6 being actuated on by a hydraulic fluid, which is brought to the necessary pressure and pumped by a hydraulic pump 8. The latter draws hydraulic fluid from the pressurized portion of the lubricating oil circuit of the internal combustion engine, which includes a lubricating-oil pump 9 and an oil sump 10 acting as a reservoir. The hydraulic fluid is therefore simply part of the engine lubricating oil. The hydraulic pump 8 pumps the hydraulic fluid by means of a single pressure-increasing and pumping element—such as, in particular, a master piston guided in a master cylinder—into a single pump conduit 11 which leads to a distributor 12, from which each of the eight individual conduits 13 in the illustrative example leads to one of the slave cylinders 6 of each throttle valve 1, hydraulically connecting this valve to the distributor 12 and the hydraulic pump 8.

The distributor is designed to rotate at half the speed of the internal combustion engine and, therefore executes one revolution per working cycle, which consists of four operational strokes. Two circular arc channels 14 and 15 rotate with the distributor 12. Of these, the shorter, pressure channel 14, occupying about a quarter of the periphery, is continuously connected to the pump conduit 11; and the longer, unpressurized channel 15, occupying almost three-quarters of the periphery, is continuously connected to a return conduit 17 leading to the suction side of the hydraulic pump 8. The eight stationary individual conduits 13 end in openings 16, evenly distributed over the periphery, on the channels 14, 15 in such a way that they are alternately connected to these channels 14, 15. During one revolution of the distributor 12, therefore, the slave piston 7 of each throttle valve 1 is acted on by hydraulic fluid for a certain length of time so that this throttle valve 1 is opened whereas, in the period in which the appropriate individual conduit 13 is connected to the unpressurized channel 15, the hydraulic fluid can flow out of the associated slave cylinder 6 and the throttle valve 1 is closed.

The position, length and number of the pressure channels 14 connected to the pump conduit 11 can be determined in a simple manner so that the start of opening, the opening duration and the number of opening operations of each throttle valve 1 per working cycle can be freely adapted to meet requirements and wishes. Thus, in a four-stroke internal combustion engine, a relatively short pressure channel 14 can open the throttle valve 1 in the vicinity of top dead center after the compression stroke and allow the compressed air to blow out into the exhaust conduit. Similarly, a second pressure channel 14 can open the throttle valve 1 for a second time, particularly at the beginning of the compression stroke, so that the cylinder 3 is charged with air which is held back in the exhaust conduit, thus increasing the compression work occurring as braking power. It is obvious that an unpressurized channel 15 connected to the return conduit 17 must follow all the pressure channels 14 in order to permit closing of the throttle valve 1.

Between the pump conduit 11 and the return conduit 17, there is a two-way solenoid valve 18 which is opened when the internal combustion engine is under load so that the hydraulic pump is 8 short-circuited and takes little power and so that action on the throttle valves 1 by hydraulic fluid is excluded; during braking operation of the internal combustion engine, the solenoid valve 18 is closed so that the hydraulic fluid pumped by the hydraulic pump 8 is fed to the distributor 12 and the throttle valves 1.

Also connected to the pump conduit 11 is a component acting as reservoir and excess pressure valve 19, which component consists of a piston 22 loaded by a spring 21 and sliding in a cylinder 20, a certain stroke of the piston 22 freeing an opening 23 in the cylinder wall, to which opening is connected an unpressurized return conduit 24 leading to the oil sump 10. This arrangement prevents the build up of excessive pressures in the hydraulic system and also affords a certain evening-out of pressure.

A bleed opening 25 is provided in the wall of the slave cylinder 6 is present in each throttle valve 1. When the throttle valve 1 is closed, the bleed opening 25 is covered by the slave piston 7. A bleed conduit 26, in which is located a throttle 27 and which emerges into the return conduit 24, is connected to the bleed opening 25.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Engine brake arrangement for an internal combustion engine of the type having a plurality of cylinders, said engine brake arrangement comprising:

at least one throttle valve associated with each of the respective cylinders, which throttle valve is in an opened position at times other than during an exhaust stroke, to connect a working cylinder space with an exhaust conduit during braking operation of the internal combustion engine;

each of said throttle valves being coupled to and actuated by a slave piston of a slave cylinder;

a hydraulic pump with a single pressure-increasing and pumping element;

a pump conduit emerging from an outlet of the hydraulic pump;

a rotating distributor connected to said pump conduit;

a plurality of individual conduit leads, each having an input coupled to said rotating distributor and an output coupled to one of said slave cylinders;

said distributor having at least one pressure channel rotating with it and permanently hydraulically connected to the pump conduit, said channel being sequentially hydraulically coupled to individual conduits leading to a throttle valve during a period when said throttle valve is in said open position.

2. Engine brake arrangement according to claim 1, wherein a throttle valve is arranged on each working cylinder in addition to an exhaust valve and is opened exclusively during braking operation of the internal combustion engine.

3. Engine brake arrangement according to claim 1, wherein the slave cylinders of the respective throttle valves are hydraulically connected to an unpressurized channel rotating with the distributor during periods when said throttle valves are in a closed position during braking operation of the internal combustion engine.

4. Engine brake arrangement according to claim 2, wherein the slave cylinders of the respective throttle valves are hydraulically connected to an unpressurized channel rotating with the distributor during periods when said throttle valves are in a closed position during braking operation of the internal combustion engine.

5. Engine brake arrangement according to claim 1, wherein the distributor rotates with half engine speed.

6. Engine brake arrangement according to claim 3, wherein the distributor rotates with half engine speed.

7. Engine break arrangement according to claim 1, wherein the at least one pressure channel and the at least one unpressurized channel extend in a peripheral direction of the distributor.

8. Engine break arrangement according to claim 5, wherein the at least one pressure channel and the at least one unpressurized channel extend in a peripheral direction of the distributor.

9. Engine brake arrangement according to claim 1, wherein each slave cylinder is hydraulically connected to the pressure channel at a time near top of dead center after a compression stroke of a four-stroke internal combustion engine.

10. Engine brake arrangement according to claim 8, wherein each slave cylinder is hydraulically connected to the pressure channel at a time near top of dead center after a compression stroke of a four-stroke internal combustion engine.

11. Engine brake arrangement according to claim 1, wherein each slave cylinder is hydraulically connected to the one pressure channel at the beginning of the compression stroke of a four-stroke internal combustion engine.

12. Engine brake arrangement according to claim 9, wherein each slave cylinder is hydraulically connected to the one pressure channel at the beginning of the compression stroke of the four-stroke internal combustion engine.

13. Engine brake arrangement according to claim 1, wherein a valve which is closed during braking operation of the internal combustion engine and is otherwise open, is located in a conduit leading from the pump conduit to one of: a return conduit or a reservoir.

14. Engine brake arrangement according to claim 11, wherein a valve which is closed during braking operation of the internal combustion engine and is otherwise open, is located in a conduit leading from the pump conduit to one of: a return conduit or a reservoir.

15. Engine brake arrangement according to claim 1, wherein a reservoir and excess pressure valve are designed as a single component to the pump conduit.

16. Engine brake arrangement according to claim 13, wherein a reservoir and excess pressure valve are designed as a single component to the pump conduit.

17. Engine brake arrangement according to claim 1, wherein a bleed conduit with a throttle is connected to the slave cylinder.

18. Engine brake arrangement according to claim 15, wherein a bleed conduit with a throttle is connected to the slave cylinder.

19. Engine brake arrangement according to claim 1, wherein lubricating oil of said internal combustion engine is used as hydraulic fluid.

20. Engine brake arrangement according to claim 10, wherein lubricating oil of said internal combustion engine is used as hydraulic fluid.

* * * * *